US012029297B1

(12) United States Patent
Chan

(10) Patent No.: US 12,029,297 B1
(45) Date of Patent: Jul. 9, 2024

(54) HANDBAG

(71) Applicant: Shenzhen Ruiyin Technology Co., Ltd., Shenzhen (CN)

(72) Inventor: Tse Long Chan, Shenzhen (CN)

( * ) Notice: Subject to any disclaimer, the term of this patent is extended or adjusted under 35 U.S.C. 154(b) by 0 days.

(21) Appl. No.: 18/446,636

(22) Filed: Aug. 9, 2023

(30) Foreign Application Priority Data

Jul. 21, 2023 (CN) ..... 202321956982.2

(51) Int. Cl.
*A45C 7/00* (2006.01)

(52) U.S. Cl.
CPC ..... *A45C 7/0045* (2013.01); *A45C 7/0095* (2013.01)

(58) Field of Classification Search
CPC ..... A45C 7/0045; A45C 7/0095
See application file for complete search history.

(56) References Cited

U.S. PATENT DOCUMENTS 4,569,082 A * 2/1986 Ainsworth ..... A45C 13/021 383/110
5,417,456 A * 5/1995 Laubacher ..... B42D 3/12 281/43
5,829,502 A * 11/1998 Distefano ..... A45C 3/00 190/110
6,626,601 B1 * 9/2003 Moor ..... B42F 11/00 150/108
6,802,348 B2 * 10/2004 Vernon ..... A45C 13/02 206/311
D930,360 S * 9/2021 Cai ..... D3/289
11,419,398 B2 * 8/2022 Harris ..... A45C 3/02
11,503,888 B1 * 11/2022 Rodrigues ..... A45C 13/005
2011/0253494 A1 * 10/2011 Coventry ..... A45C 3/06 190/110
2021/0244148 A1 * 8/2021 Harris ..... A45C 11/00

FOREIGN PATENT DOCUMENTS

FR 3017518 A3 * 8/2015 ..... A45C 1/08
KR 20130002116 U * 4/2013
WO WO-8404872 A1 * 12/1987

* cited by examiner

*Primary Examiner* — Tri M Mai

(57) ABSTRACT

The present disclosure provides a handbag, including a first panel, a second panel, and an intermediate portion connected to the first panel and the second panel; the handbag further includes an insert member received in a holding space enclosed by the first panel, the second panel, and the intermediate portion, and the insert member includes a third panel, a fourth panel, and a ridge portion connected to the third panel and the fourth panel; the ridge portion is detachably connected to the intermediate portion.

7 Claims, 12 Drawing Sheets

HANDBAG

CROSS REFERENCE

The present disclosure claims priority of Chinese Patent Application No. 202321956982.2, filed on Jul. 21, 2023, the entire contents of which are hereby incorporated by reference in their entirety.

TECHNICAL FIELD

The present disclosure relates to technical field of cases, especially to a handbag.

BACKGROUND

Handbags are portable bags that can be carried around to hold lightweight things. With the continuous improvement of people's consumption level, various kinds of handbags have become indispensable accessories in daily life, and the practicality of handbags has also been strengthened.

Conventional handbags have compartments or pouches inside for the convenience of organizing and classifying the items put into, however, this design is still not enough to cope with the different needs of use.

SUMMARY OF THE DISCLOSURE

Based on this, it is necessary to propose a handbag having multiple ways of use.

The present disclosure provides a handbag, including: a first panel, a second panel, and an intermediate portion connected to the first panel and the second panel; and an insert member, received in a holding space enclosed by the first panel, the second panel, and the intermediate portion; wherein the insert member includes a third panel, a fourth panel, and a ridge portion connected to the third panel and the fourth panel; the ridge portion is detachably connected to the intermediate portion.

In some embodiments, the insert member further includes a strip portion disposed on a side of the ridge portion facing the intermediate portion, and a gap exists between the strip portion and the ridge portion.

In some embodiments, the strip portion is releasably connected to the ridge portion.

In some embodiments, the intermediate portion includes a first edge and a second edge that are opposite to each other; the first panel is pivotally connected to the first edge, and the second panel is pivotally connected to the second edge.

In some embodiments, edges of the first panel and the second panel other than edges connected to the intermediate portion are each arranged with a releasable first connecting mechanism.

In some embodiments, the ridge portion includes a third edge and a fourth edge that are opposite to each other; the third panel is pivotally connected to the third edge, and the fourth panel is pivotally connected to the fourth edge.

In some embodiments, edges of the third panel and the fourth panel other than edges connected to the ridge portion are each arranged with a releasable second connecting mechanism.

The present disclosure provides a handbag, including a first panel, a second panel, and an intermediate portion connected to the first panel and the second panel; the handbag further includes an insert member received in a holding space enclosed by the first panel, the second panel, and the intermediate portion, and the insert member includes a third panel, a fourth panel, and a ridge portion connected to the third panel and the fourth panel; the ridge portion is detachably connected to the intermediate portion. Since the insert member can be received in the holding space of the handbag and is detachably connected to the intermediate portion of the handbag, the handbag can be used in a variety of ways to cope with different usage needs.

BRIEF DESCRIPTION OF THE DRAWINGS

In order to more clearly illustrate the technical solutions in the specific embodiments or related art of the present disclosure, the accompanying drawings to be used in the description of the specific embodiments or related art will be briefly introduced below. It will be obvious that the accompanying drawings in the following description are some of the embodiments of the present disclosure, and that for those skilled in the art, other attachments can be obtained based on these accompanying drawings without putting in creative labor.

DETAILED DESCRIPTION

The following will be a clear and complete description of the technical solutions in the embodiments of the present disclosure in conjunction with the accompanying drawings in the embodiments of the present disclosure. Obviously, the described embodiments are only a part of the embodiments of the present disclosure, and not all of them. Based on the embodiments in the present disclosure, all other embodiments obtained by those skilled in the art without creative labor fall within the scope of the present disclosure.

In the description of the present disclosure, it is noted that when the terms "center", "up", "down", "left", "right", "vertical", "horizontal", "inner", "outer", etc. appear, they are indicative of an orientation or positional relationship based on that shown in the accompanying drawings, which is intended only to facilitate and simplify the description of the present disclosure and is not indicative of, or suggestive of, the necessity for the device or element referred to to be of a particular orientation, or to be constructed and operated in a particular orientation, and therefore is not to be construed as a limitation of the present disclosure. Furthermore, the terms "first", "second", "third", if present, are used for descriptive purposes only and are not to be understood as indicating or implying relative importance.

Figure 1:
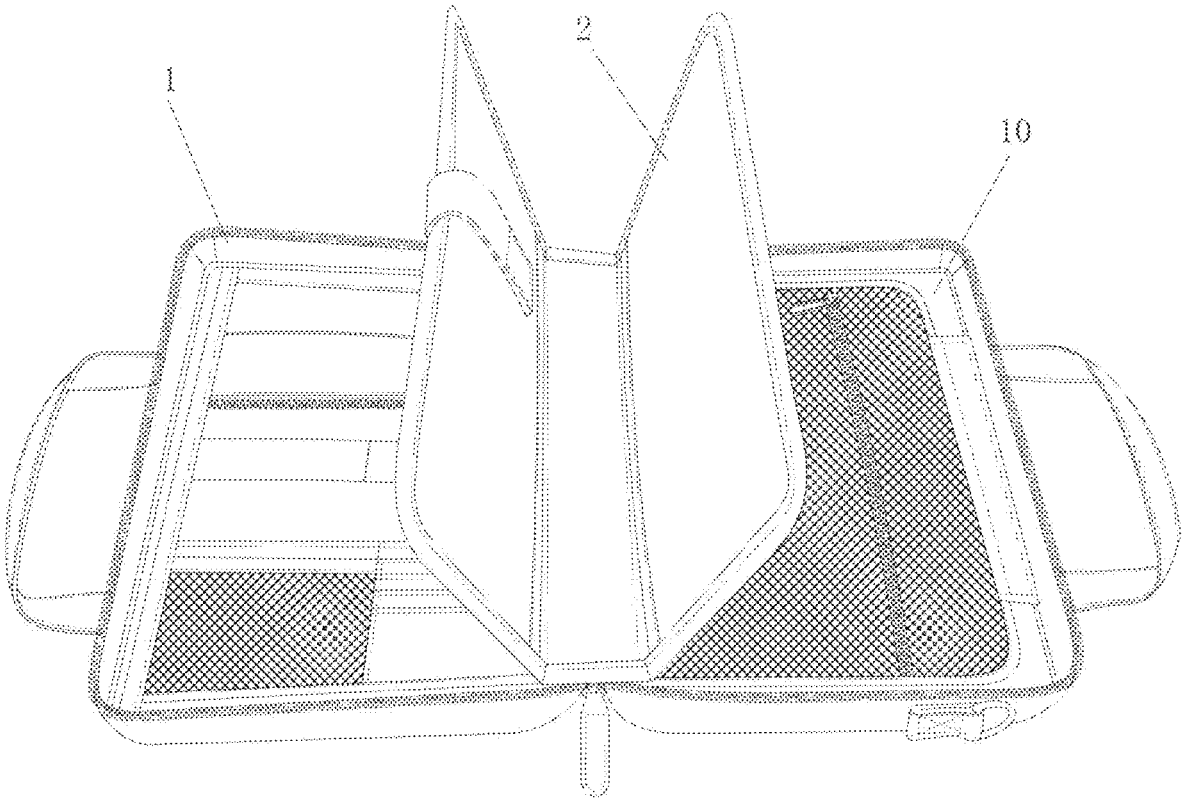
FIG. 1 is an assembled structural schematic view of a handbag according to an embodiment of the present disclosure.
Figure 2:
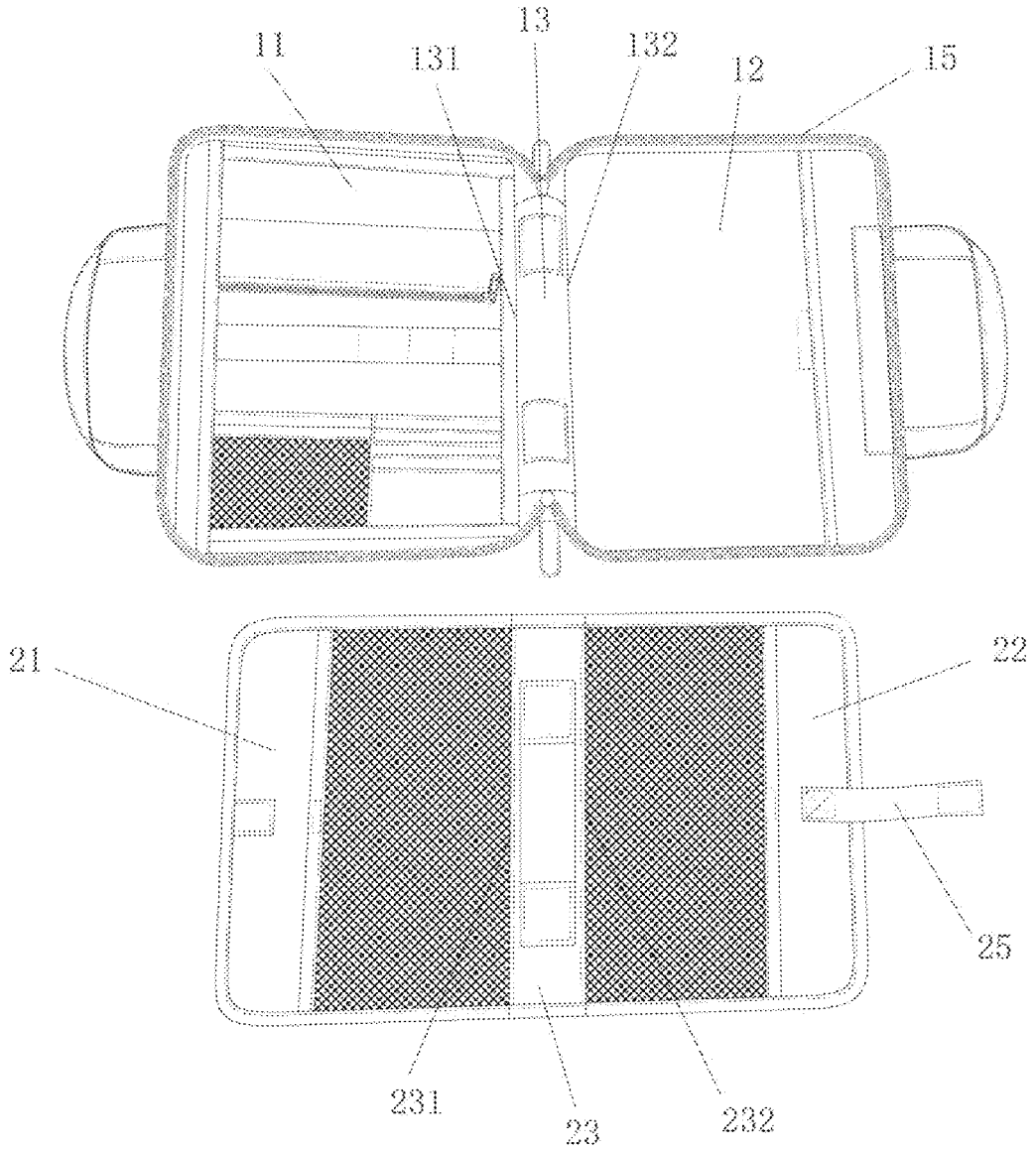
FIG. 2 is a disassembled structural schematic view of a handbag according to an embodiment of the present disclosure.

Referring to FIGS. 1 and 2, the present disclosure provides a handbag 1 including a first panel 11, a second panel 12, and an intermediate portion 13 connected to the first panel 11 and the second panel 12, the first panel 11, the second panel 12, and the intermediate portion 13 enclosing a holding space 10. The intermediate portion 13 includes a first edge 131 and a second edge 132 that are opposite to each other. In the embodiments, the first panel 11 is pivotally connected to the first edge 131 and the second panel 12 is pivotally connected to the second edge 132. Specifically, edges of the first panel 11 and the second panel 12 other than edges connected to the intermediate portion 13 are each arranged with a releasable first connecting mechanism 15 (e.g., a zipper), such that the handbag 1 can be unfolded to a state that the first panel 11, the second panel 12, and the intermediate portion 13 are in the same plane, and can be opened to a state that the holding space 10 can be just entered.

The handbag 1 further includes an insert member 2 received in the holding space 10, the insert member 2 including a third panel 21, a fourth panel 22, and a ridge portion 23 connected to the third panel 21 and the fourth panel 22; the ridge portion 23 is removably connected to the intermediate portion 13. In the embodiments, when the first panel 11, the second panel 12, and the intermediate portion 13 are unfolded to the same plane, the ridge portion 23 can be quickly and easily mounted on the intermediate portion 13 or removed from the intermediate portion 13. However, it is to be understood that even without the first connecting mechanism 15, it is only necessary that the handbag 1 has an opening for the insert member 2 to enter the holding space 10, and that the ridge portion 23 and the intermediate portion 13 are connected in a removable manner, to realize the technical solution of the present disclosure.

In some embodiments, the ridge portion 23 includes a third edge 231 and a fourth edge 232 that are opposite to each other, the third panel 21 being pivotally connected to the third edge 231 and the fourth panel 22 being pivotally connected to the fourth edge 232. In the embodiments, the third panel 21, the fourth panel 22, and the ridge portion 23 are substantially in the shape of a plate, made of or including a rigid material. When the insert member 2 is fixed within the handbag 1, the third panel 21 and the fourth panel 22 may act as partitions to divide the holding space 10 of the handbag 1 into multiple compartments; when the insert member 2 is removed individually, the insert member 2 may be unfolded at different angles like a binder. Further, edges of the third panel 21 and the fourth panel 22 other than edges connected to the ridge portion 23 are each arranged with a releasable second connecting mechanism 25, and the second connecting mechanism 25 is configured to keep the insert member 2 folded up. In the embodiments, the second connecting mechanism 25 may be a buckling strap arranged at the edges of the third panel 21 and the fourth panel 22 away from the ridge portion 23. It will be appreciated that the third panel 21, the fourth panel 22, and the ridge portion 23 may be made of a soft material such as a fabric, and the second connecting mechanism 25 may be a zipper, a button, or a retractable strap. In some embodiments, the insert member 2 may be arranged with a carrying handle.

In this way, since the insert member 2 can be received in the holding space of the handbag 1 and is detachably connected to the intermediate portion 13 of the handbag 1, the user can use the handbag 1 without placing the insert member 2 inside the handbag 1 in order to obtain a larger holding space, or placing the insert member 2 inside the handbag in order to compartmentalize the holding space, and can also remove the insert member 2 individually at any time to use the insert member 2 as a stand-alone container, making the handbag 1 usable in a variety of ways to cope with different usage needs.

Figure 3A:
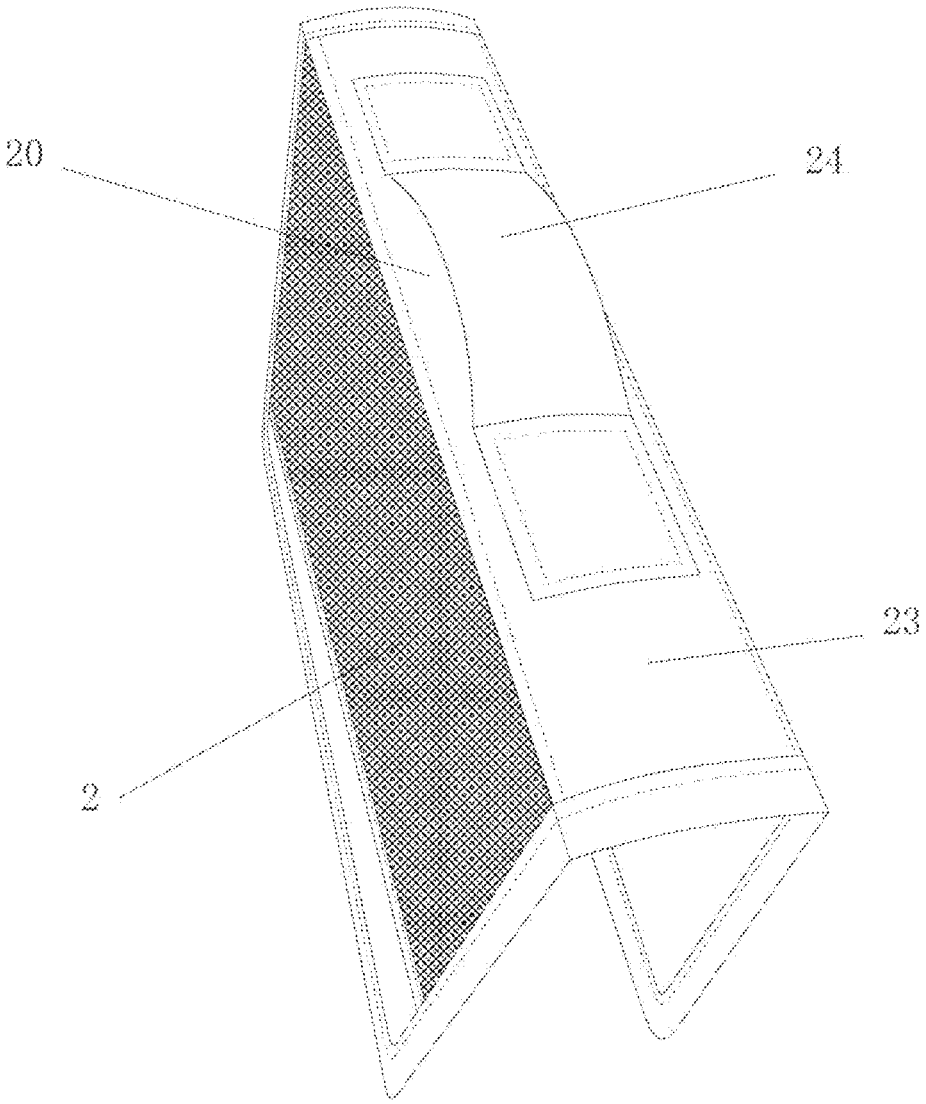
FIG. 3A is a schematic view of an insert member according to an embodiment of the present disclosure.

Further, as shown in FIG. 3A, the insert member 2 further includes a strip portion 24 disposed on a side 230 of the ridge portion 23 facing the intermediate portion 13, and a gap 20 exists between the strip portion 24 and the ridge portion 23. Specifically, the gap 20 can be passed through by at least one finger, such that when the user takes the insert member 2 alone, the finger can pass through the gap 20 to hold the insert member 2 securely and avoid the insert member 2 slipping out of the hand. The strip portion 24 may be an elastic fabric, a non-elastic fabric, leather or plastic (PVC), etc.

Figure 3B:
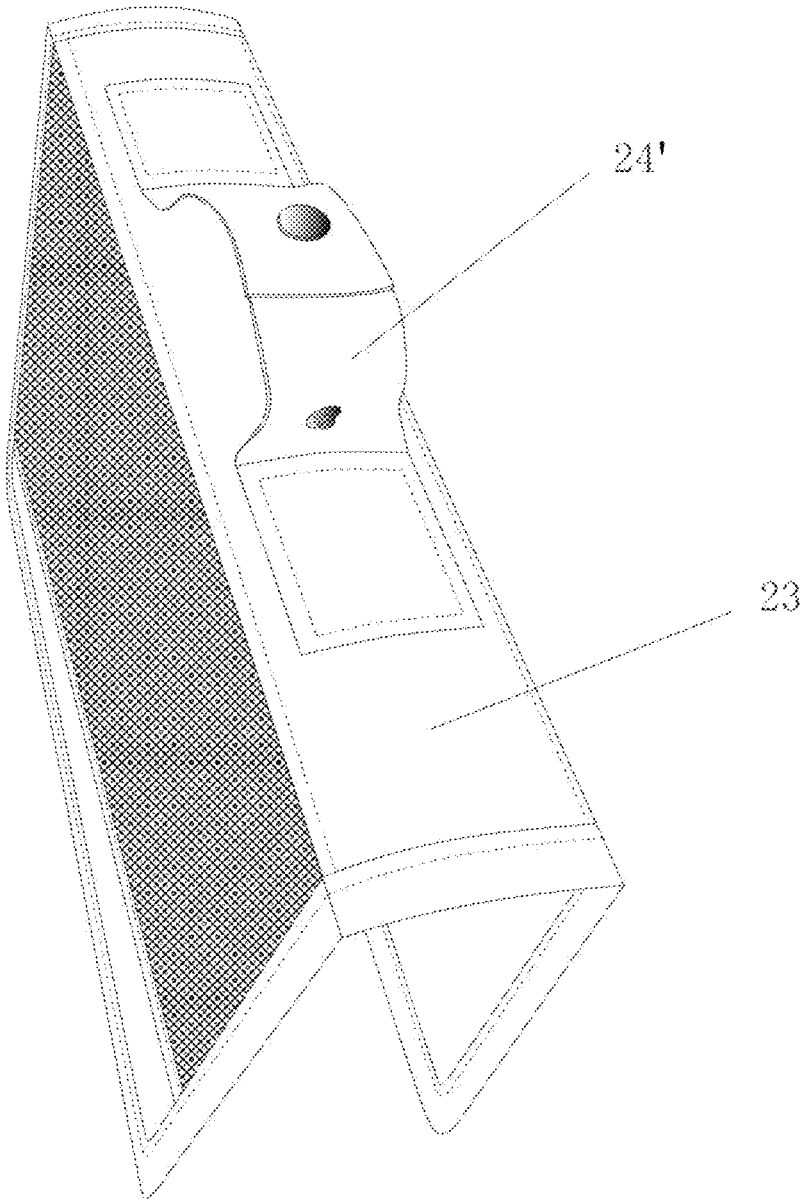
FIG. 3B is a schematic view of an insert member according to another embodiment of the present disclosure.
Figure 3C:
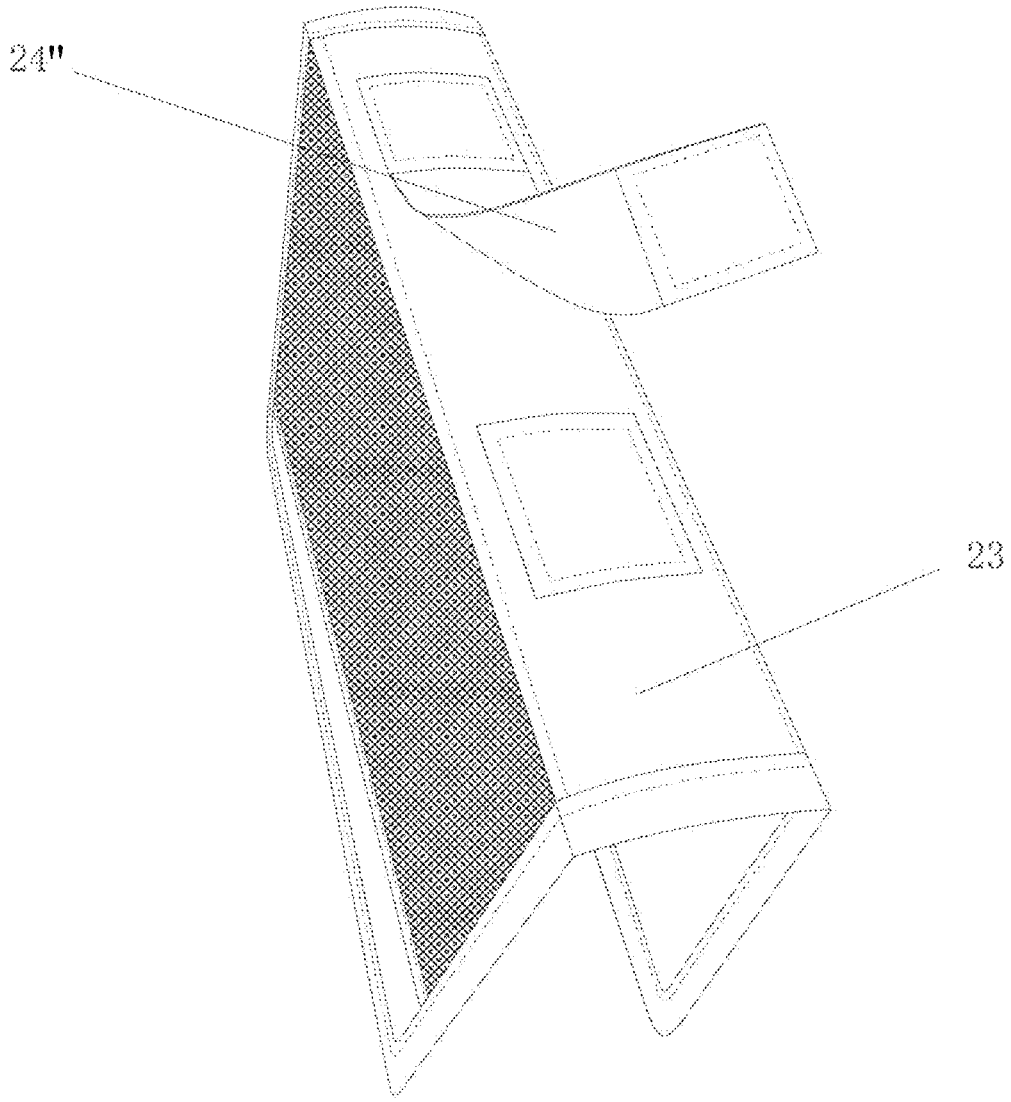
FIG. 3C is a schematic view of an insert member according to further another embodiment of the present disclosure.
Figure 3D:
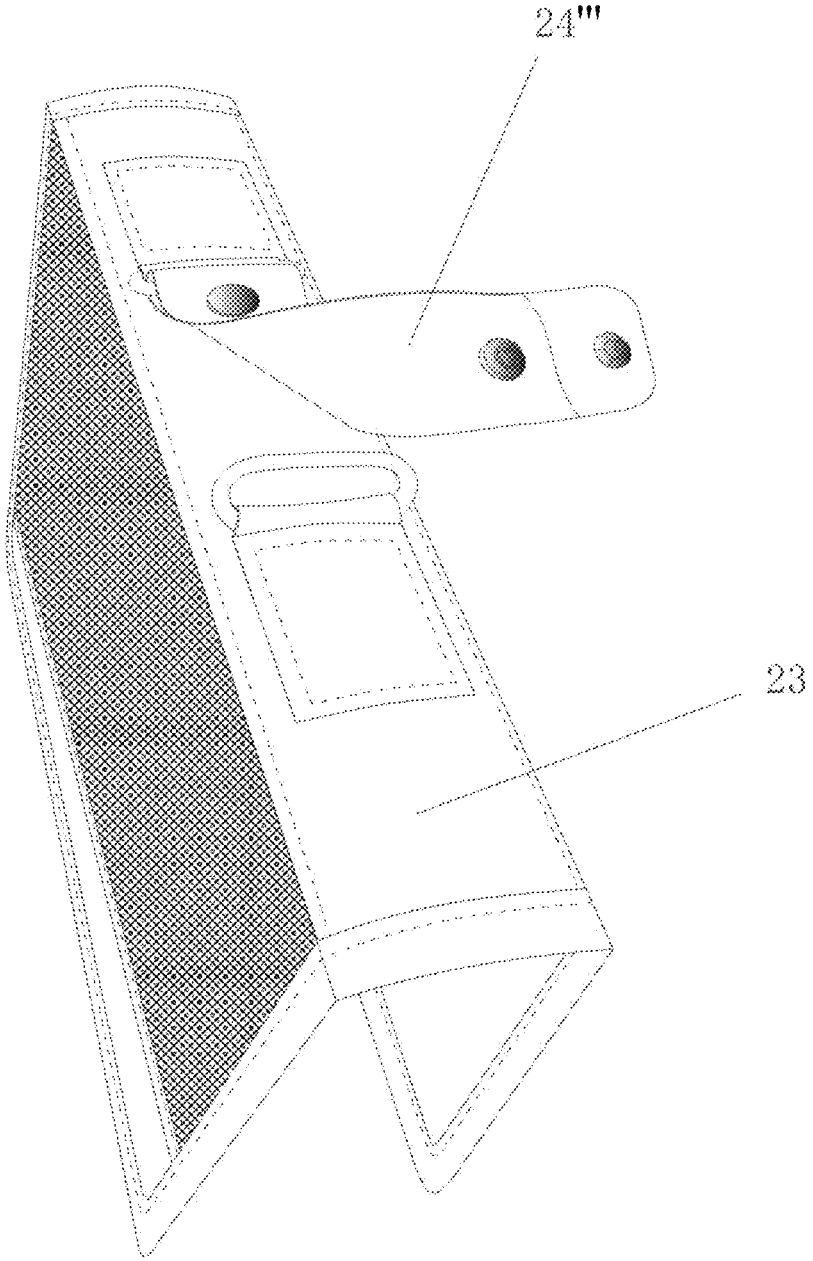
FIG. 3D is a schematic view of an insert member according to still another embodiment of the present disclosure.

In some embodiments, the strip portion 24 is releasably connected to the ridge portion 23, as shown in FIG. 3B-FIG. 3D. In the embodiment shown in FIG. 3B, both ends of the strip portion 24 are fixed to the ridge portion 23, and a middle portion of the strip portion 24 is disconnected and connected by buttons, magnets, Velcro, or other similar attachment means. In the embodiment shown in FIG. 3C, an end of the strip portion 24 is fixed to the ridge portion 23, and the other end is detachably connected to the ridge portion 23 by buttons, magnets, Velcro, or other similar attachment means. In the embodiment shown in FIG. 3D, both ends of the strip portion 24 are detachably connected to the ridge portion 23 by buttons, magnets, Velcro, metal hook-and-loop fasteners, plastic insert fasteners, or other similar attachment means. In this way, the size of the gap 20 can be adjusted, and the strip portion 24 can be removed when the strip portion 24 is not needed.

FIG. 4A-FIG. 4F illustrate a variety of ways in which the insert member 2 fits with the intermediate portion 13.

Figure 4A:
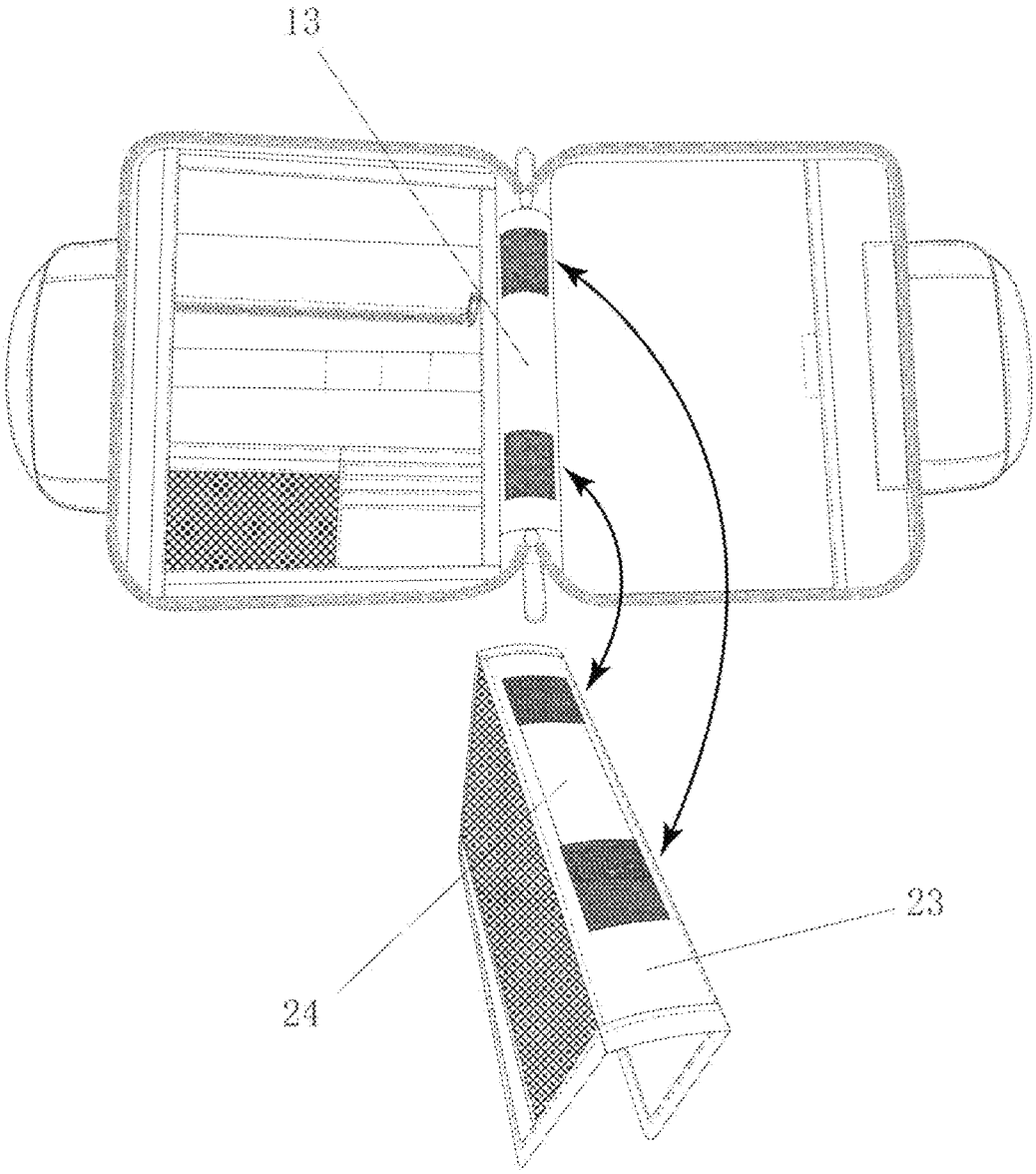
FIG. 4A is a schematic view of an insert member mating with an intermediate portion according to an embodiment of the present disclosure.
Figure 4B:
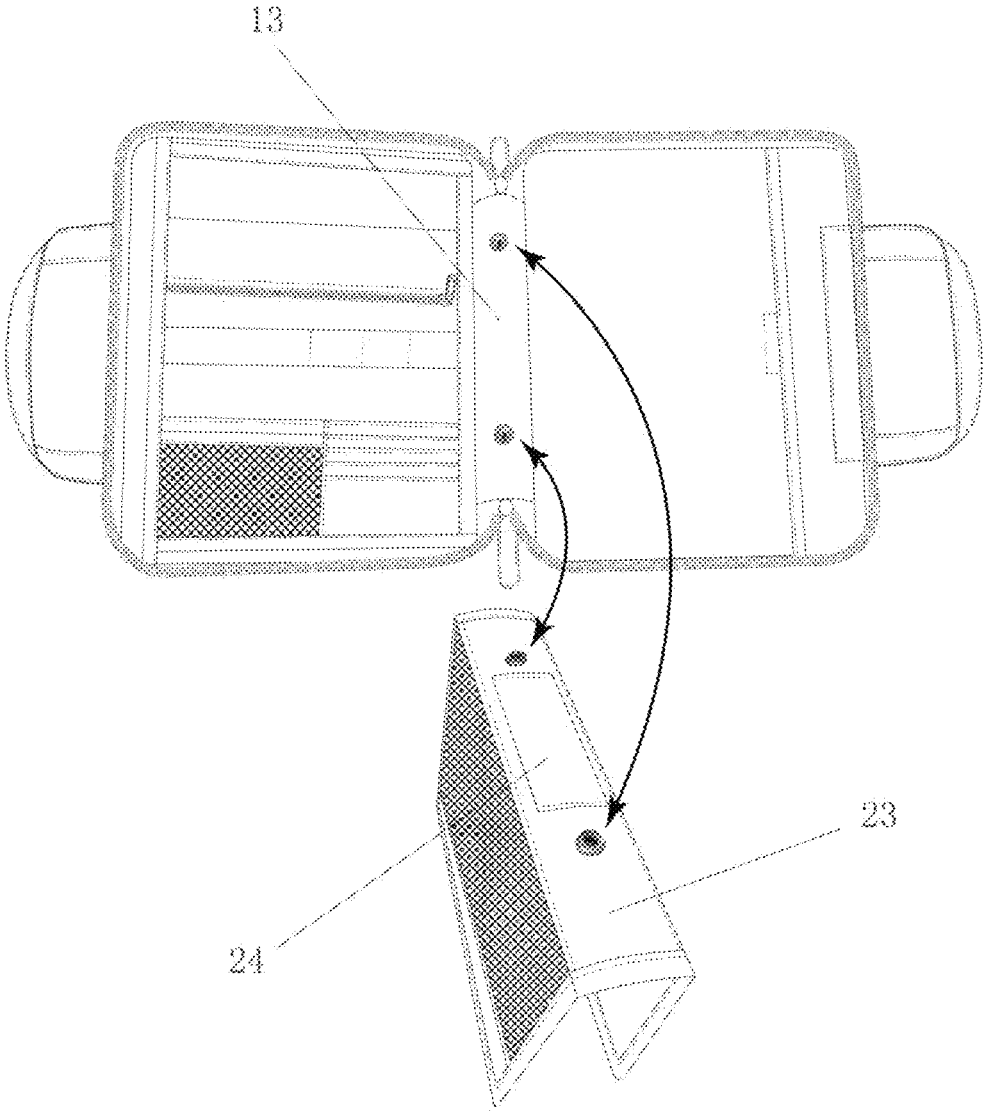
FIG. 4B is a schematic view of an insert member mating with an intermediate portion according to another embodiment of the present disclosure.

As shown in FIG. 4A and FIG. 4B, both ends of the ridge portion 23 at the strip portion 24 are arranged with Velcro, snap fasteners, magnetic fasteners, or similar connectors, and the intermediate portion 13 is arranged with adapted connectors at least at corresponding locations.

Figure 4C:
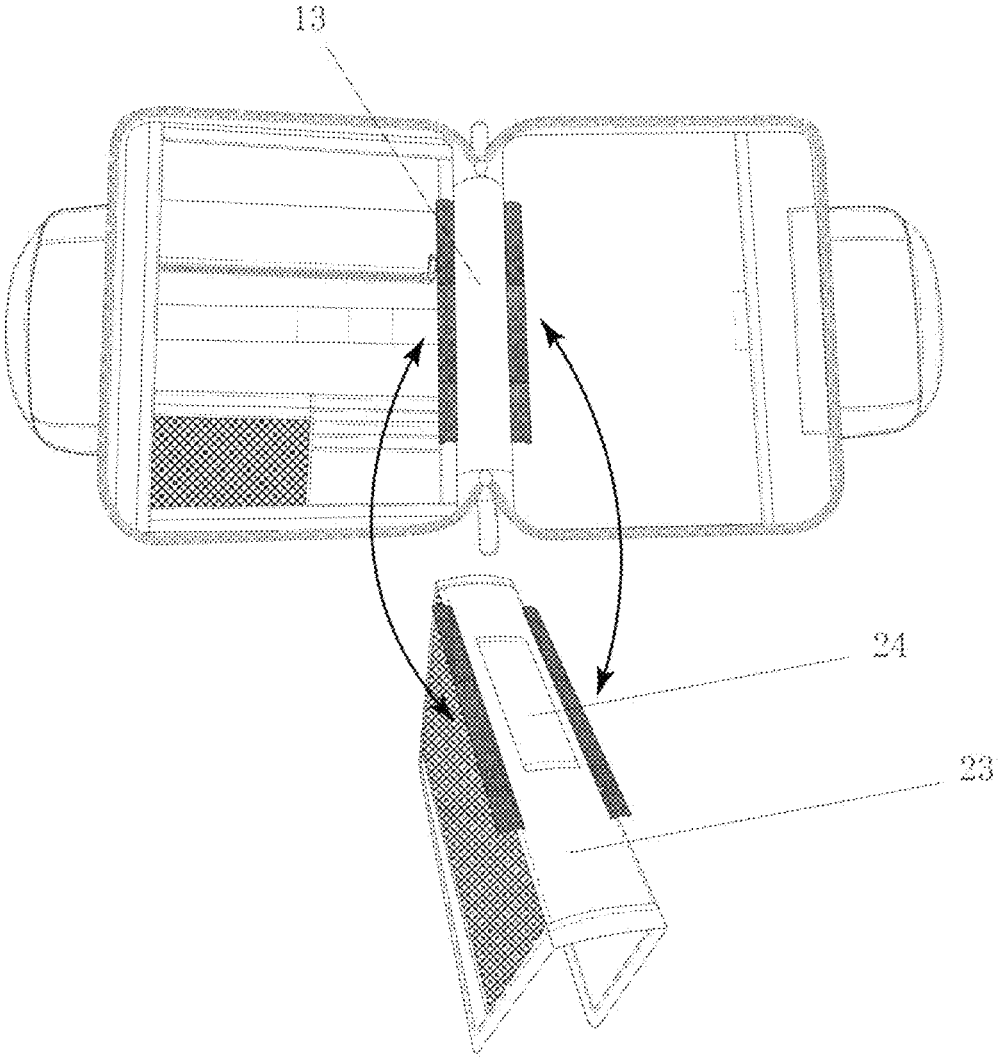
FIG. 4C is a schematic view of an insert member mating with an intermediate portion according to further another embodiment of the present disclosure.
Figure 4D:
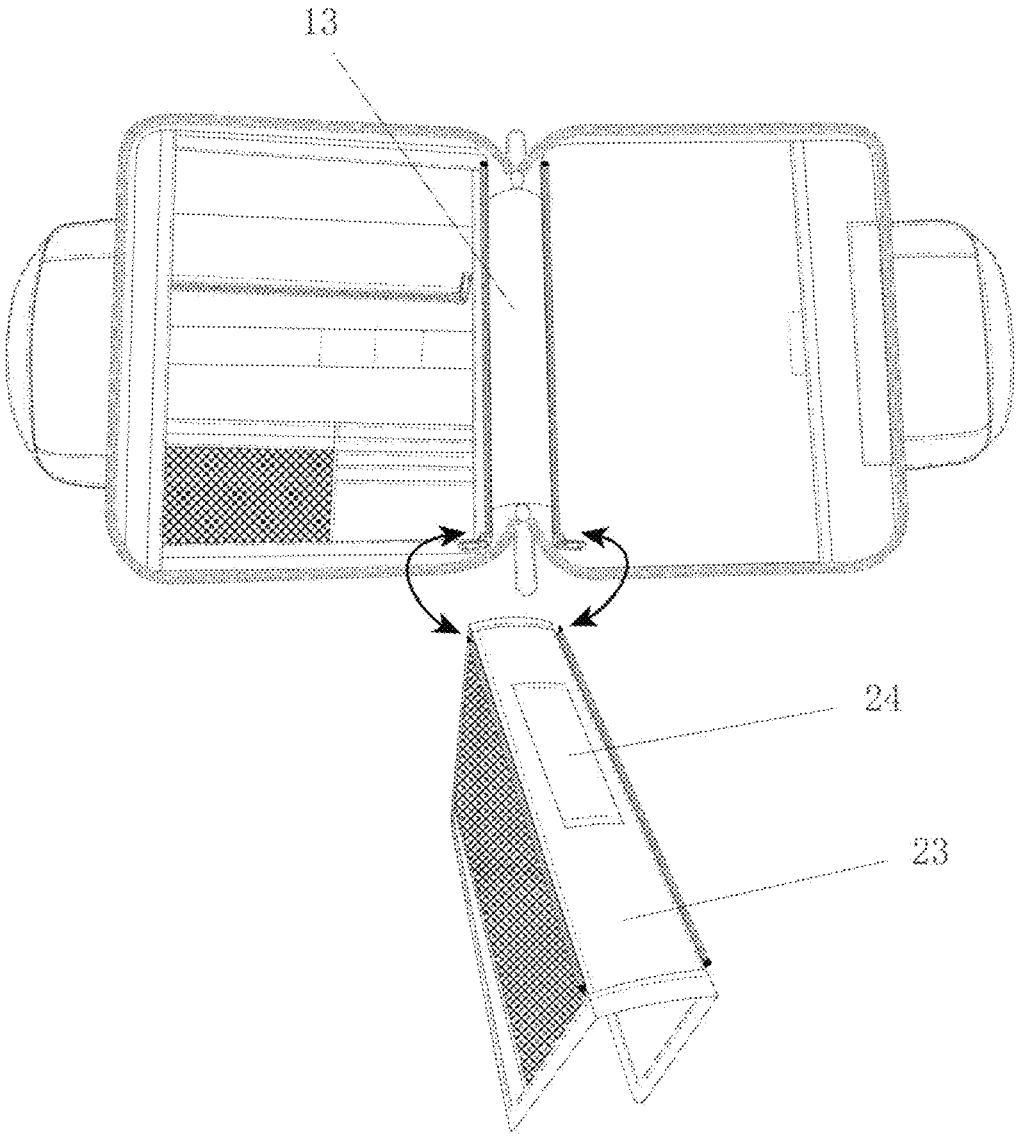
FIG. 4D is a schematic view of an insert member mating with an intermediate portion according to still another embodiment of the present disclosure.

As shown in FIGS. 4C and 4D, both ends of the ridge portion 23 at the strip portion 24 are arranged d with Velcro, zippers, or similar connectors, and the intermediate portion 13 is arranged with adapted connectors at corresponding positions.

Figure 4E:
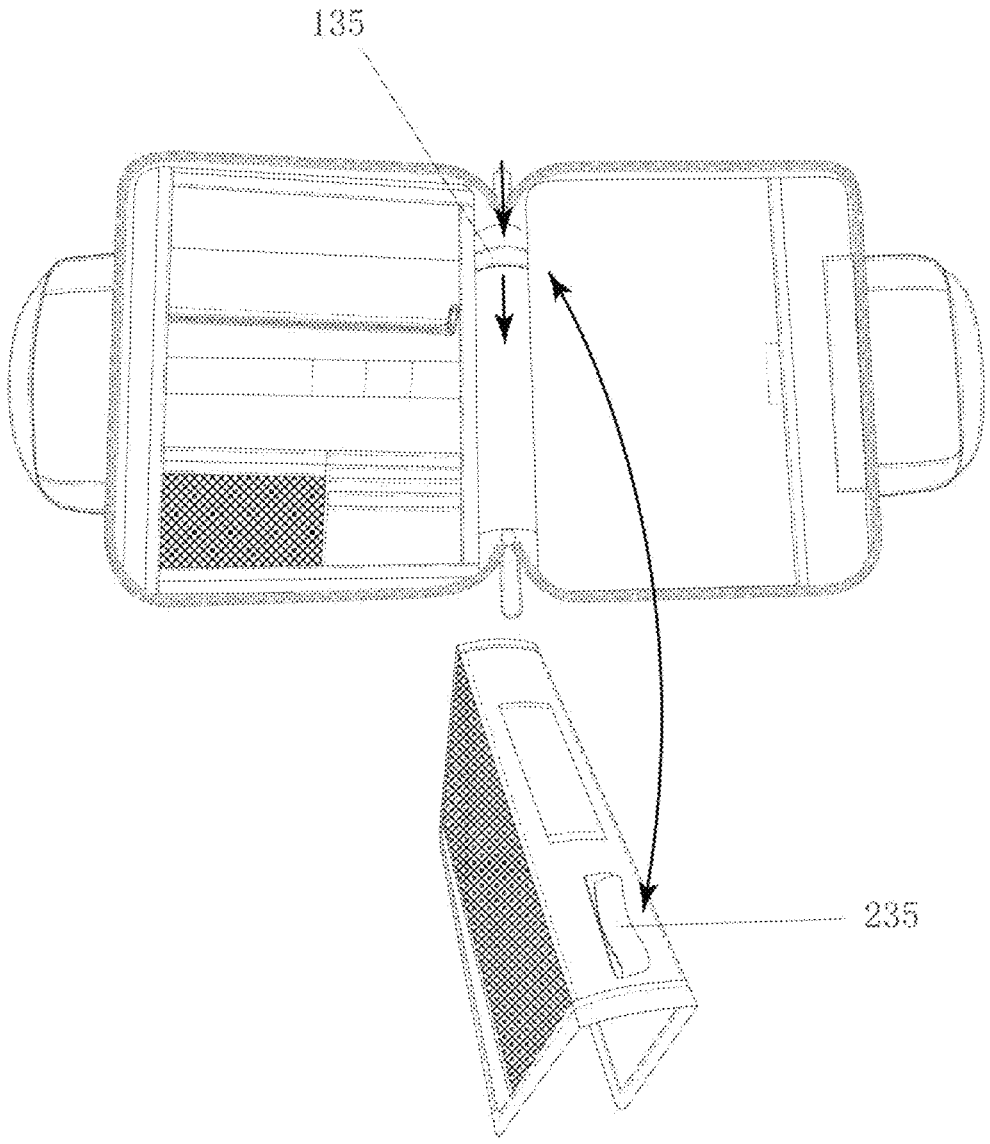
FIG. 4E is a schematic view of an insert member mating with an intermediate portion according to still another embodiment of the present disclosure.

As shown in FIG. 4E, the intermediate portion 13 defines a through hole 135, the ridge portion 23 is arranged with a clip 235, and the removable connection between the ridge portion 23 and the intermediate portion 13 is realized by clamping the clip on the intermediate portion 13.

Figure 4F:
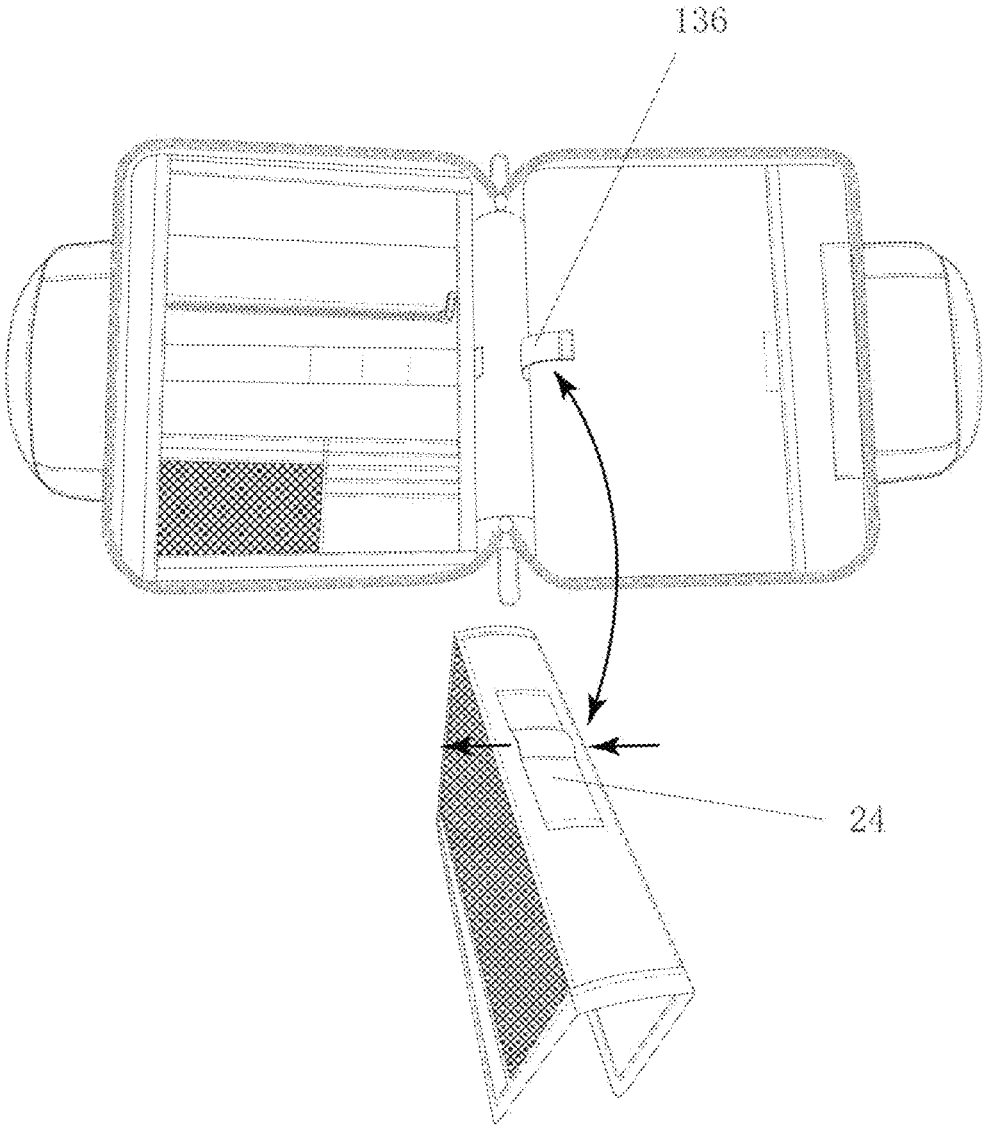
FIG. 4F is a schematic view of an insert member mating with an intermediate portion according to still another embodiment of the present disclosure.

As shown in FIG. 4F, the intermediate portion 13 may be arranged with a buckle strap 136 that passes through the gap 20.

It can be understood that as long as the ridge portion 23 can be detachably connected to the intermediate portion 13 of the handbag 1, regardless of the method of connection, it is within the scope of the technical solution of the present disclosure.

The present disclosure provides a handbag, including a first panel, a second panel, and an intermediate portion connected to the first panel and the second panel; the handbag further includes an insert member received in a holding space enclosed by the first panel, the second panel, and the intermediate portion, and the insert member includes a third panel, a fourth panel, and a ridge portion connected to the third panel and the fourth panel; the ridge portion is detachably connected to the intermediate portion. Since the insert member can be received in the holding space of the handbag and is detachably connected to the intermediate portion of the handbag, the handbag can be used in a variety of ways to cope with different usage needs.

The above embodiments are only intended to illustrate the technical solution of the present disclosure, not to limit it; although the present disclosure has been described in detail with reference to the foregoing embodiments, those skilled in the art should understand that it is still possible to modify the technical solution recorded in the foregoing embodiments, or to replace some or all of the technical features with equivalent ones; and these modifications or replacements do not make the corresponding technical solution deviate from the essence of the technical solution of the present disclosure.

What is claimed is:

1. A handbag, comprising:

a first panel, a second panel, an intermediate portion connected to the first panel and the second panel, and an insert member, received in a holding space enclosed by the first panel, the second panel, and the intermediate portion; wherein the insert member comprises a third panel, a fourth panel, and a ridge portion connected to the third panel and the fourth panel; the ridge portion is detachably connected to the intermediate portion;

the insert member further comprises a strip portion disposed on a side of the ridge portion facing the intermediate portion, and a gap exists between the strip portion and the ridge portion;

at least one end of the strip portion is fixedly connected to the ridge portion; when the ridge portion is connected to the intermediate portion, the strip portion is located between the ridge portion and the intermediate portion;

wherein both ends of the strip portion are fixed to the ridge portion, and a middle portion of the strip portion is detachably connected by buttons or magnets.

2. The handbag according to claim 1, wherein the intermediate portion comprises a first edge and a second edge that are opposite to each other; the first panel is pivotally connected to the first edge, and the second panel is pivotally connected to the second edge.

3. The handbag according to claim 2, wherein a releasable first connecting mechanism is arranged on edges of the first panel and the second panel other than edges connected to the intermediate portion.

4. The handbag according to claim 1, wherein the ridge portion comprises a third edge and a fourth edge that are opposite to each other; the third panel is pivotally connected to the third edge, and the fourth panel is pivotally connected to the fourth edge.

5. The handbag according to claim 4, wherein edges of the third panel and the fourth panel other than edges connected to the ridge portion are each arranged with a releasable second connecting mechanism.

6. A handbag, comprising:

a first panel, a second panel, an intermediate portion connected to the first panel and the second panel, and an insert member, received in a holding space enclosed by the first panel, the second panel, and the intermediate portion; wherein the insert member comprises a third panel, a fourth panel, and a ridge portion connected to the third panel and the fourth panel; the ridge portion is detachably connected to the intermediate portion;

the insert member further comprises a strip portion disposed on a side of the ridge portion facing the intermediate portion, and a gap exists between the strip portion and the ridge portion;

at least one end of the strip portion is fixedly connected to the ridge portion; when the ridge portion is connected to the intermediate portion, the strip portion is located between the ridge portion and the intermediate portion;

wherein the intermediate portion defines a through hole, the ridge portion is provided with a clip; an end of the clip is inserted into the through hole, such that the ridge portion is connected to the intermediate portion.

7. A handbag comprising:

a first panel, a second panel, an intermediate portion connected to the first panel and the second panel, and an insert member, received in a holding space enclosed by the first panel, the second panel, and the intermediate portion; wherein the insert member comprises a third panel, a fourth panel, and a ridge portion connected to the third panel and the fourth panel; the ridge portion is detachably connected to the intermediate portion;

the insert member further comprises a strip portion disposed on a side of the ridge portion facing the intermediate portion, and a gap exists between the strip portion and the ridge portion;

at least one end of the strip portion is fixedly connected to the ridge portion; when the ridge portion is connected to the intermediate portion, the strip portion is located between the ridge portion and the intermediate portion;

wherein the intermediate portion is provided with a buckle strap; the buckle strap passes through the gap, such that the ridge portion is connected to the intermediate portion.

* * * * *